US005211456A

United States Patent [19]

Staffaroni

[11] Patent Number: 5,211,456

[45] Date of Patent: May 18, 1993

[54] WALL MOUNTABLE PROJECTOR CABINET

[76] Inventor: Michael J. Staffaroni, 2135 Aquilla Ave. N., Golden Valley, Minn. 55427

[21] Appl. No.: 763,316

[22] Filed: Sep. 20, 1991

[51] Int. Cl.[5] ..... A47B 5/00

[52] U.S. Cl. ..... 312/10.1; 108/134

[58] Field of Search ..... 108/134, 135; 312/10.1, 312/248; 353/119; 352/242, 243

[56] References Cited

U.S. PATENT DOCUMENTS

| | | | |
|---|---|---|---|
| 1,581,427 | 4/1926 | Cummings | 108/134 |
| 1,864,599 | 6/1932 | Linden . | |
| 1,966,800 | 7/1934 | Katzman | 312/112 |
| 2,121,910 | 6/1938 | Freimann | 353/17 |
| 2,848,244 | 7/1958 | Bennett | 108/38 |
| 2,872,178 | 2/1959 | Holland | 265/27 |
| 3,333,912 | 8/1967 | Kunz | 312/231 |
| 3,880,507 | 4/1975 | Adams | 353/119 |

FOREIGN PATENT DOCUMENTS

| | | | |
|---|---|---|---|
| 1200489 | 9/1965 | Fed. Rep. of Germany | 108/134 |
| 91/11130 | 8/1991 | World Int. Prop. O. | 108/134 |

*Primary Examiner*—James R. Brittain

*Assistant Examiner*—Gerald A. Anderson

*Attorney, Agent, or Firm*—James V. Harmon

[57] ABSTRACT

The invention provides a wall mountable projector cabinet which has a cabinet body with a back wall, upright side walls, a top wall and a bottom wall connected together to provide an enclosure behind a projector. The cabinet has an upright front projector supporting door which also acts as a shelf for holding the projector. A transversely positioned hinge connected to the bottom of the door extends between the side walls and is located in spaced relationship above the bottom wall of the cabinet, enabling the projector supporting door to swing downwardly from the top about the horizontal hinge. A storage compartment is preferably provided between the hinge and the bottom wall of the cabinet. An upright slot is provided in the cabinet below the hinge and above the bottom wall of the cabinet. A brace arm is pivotally connected at an upper end to the door and extends through the slot into the cabinet. The cabinet also includes a retaining member positioned to engage a portion of the brace arm for supporting the brace arm in position to hold the door when the door is opened in a generally horizontal position with the projector resting thereupon for projecting visual images.

19 Claims, 2 Drawing Sheets

WALL MOUNTABLE PROJECTOR CABINET

FIELD OF THE INVENTION

The present invention relates to projection equipment and more particularly to a wall mountable cabinet for supporting a projector used for the projection of visual images.

BACKGROUND OF THE INVENTION

Cabinets of various designs have been previously proposed, but none have been well suited for storing, supporting and deploying projection equipment, e.g. slide projectors, movie projectors, video projectors and the like. Since the "media room" is becoming more important in business, as well as in the home, there is a need for an article that can be mounted upon or recessed into the wall for supporting projection equipment. Up to the present time, projection equipment is usually stored in an ordinary table or desk. Normally, just before use, it is taken out of a drawer in the table or desk and then must be placed on the surface of the table or desk and plugged in to prepare it for use. The major objective of the invention is to eliminate all of this inconvenience and to provide a highly compact integrated storage system for keeping the projection equipment in an out-of-the-way location and, optionally, locked but at the same time permitting it to be quickly deployed and firmly supported in a stable position ready for use. It is another object to keep the space on either side of the projector open and uncluttered so that the operator can easily reach the projector from any angle, for example for the purpose of placing slides on the projector, mounting film, operating switches, etc. Another object is to provide convenient storage space for auxiliary equipment, as well as the projector itself. A more specific object is to provide a combined security device and compact cabinet for storing projection equipment and for allowing the equipment to be easily moved to position for use. Another object is to provide a secure cabinet for projection equipment which can be locked, if desired, and which will consistently support the projection equipment at an optimal focal position with respect to a projection screen located in the room. A further object is to provide a supporting platform or shelf that can be moved to a deployed position reliably supporting the projection equipment a predetermined distance from the projection screen. Another object is to provide an upper storage chamber for the projection equipment, a lower storage compartment for auxiliary equipment and a passage between them for an electrical connector such as a power cord. Still another object is to provide a supporting door that serves as a shelf for the projection equipment and a provision for reliably supporting the shelf from below.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

The invention provides a wall mountable projector cabinet which has a cabinet body with a back wall, upright side walls, a top wall and a bottom wall connected together to provide an enclosure behind a projector. The cabinet has an upright front projector supporting door which also acts as a shelf for holding the projector. A transversely positioned hinge connected to the bottom of the door extends between the side walls and is located in spaced relationship above the bottom wall of the cabinet, enabling the projector supporting door to swing downwardly from the top about the horizontal hinge. A storage compartment is preferably provided between the hinge and the bottom wall of the cabinet. An upright slot is provided in the cabinet below the hinge and above the bottom wall of the cabinet. A brace arm is pivotally connected at an upper end to the door and extends through the slot into the cabinet. The cabinet also includes a retaining member positioned to engage a portion of the brace arm for supporting the brace arm in position to hold the door when the door is opened in a generally horizontal position with the projector resting thereupon for projecting visual images.

THE FIGURES

DETAILED DESCRIPTION OF THE INVENTION

Figure 1:
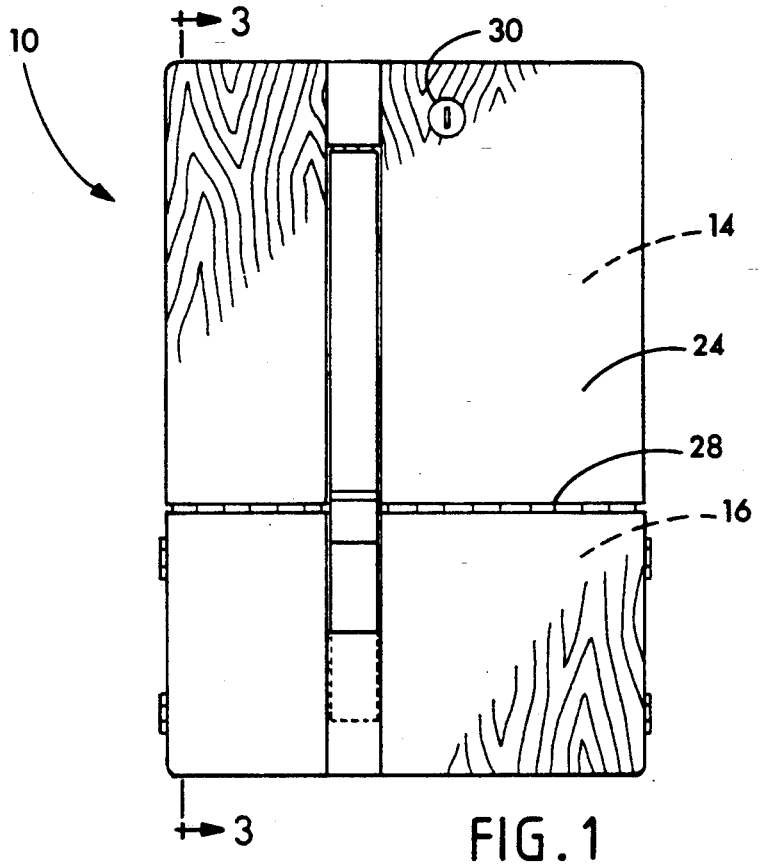
FIG. 1 is a front elevational view of the invention.

Shown in the figures is a generally rectangular wall mountable projector cabinet 10 including vertically disposed, laterally spaced apart side walls 18, 22 and transversely extending vertically spaced apart top and bottom walls 20, 23 and a back wall 25, all connected together to form an enclosure for enclosing a visual apparatus such as a slide projector 12. While the invention is being described with a slide projector 12, it should be understood that the slide projector 12 could comprise a movie or video projector for projecting visual images onto a screen (not shown).

Figure 2:
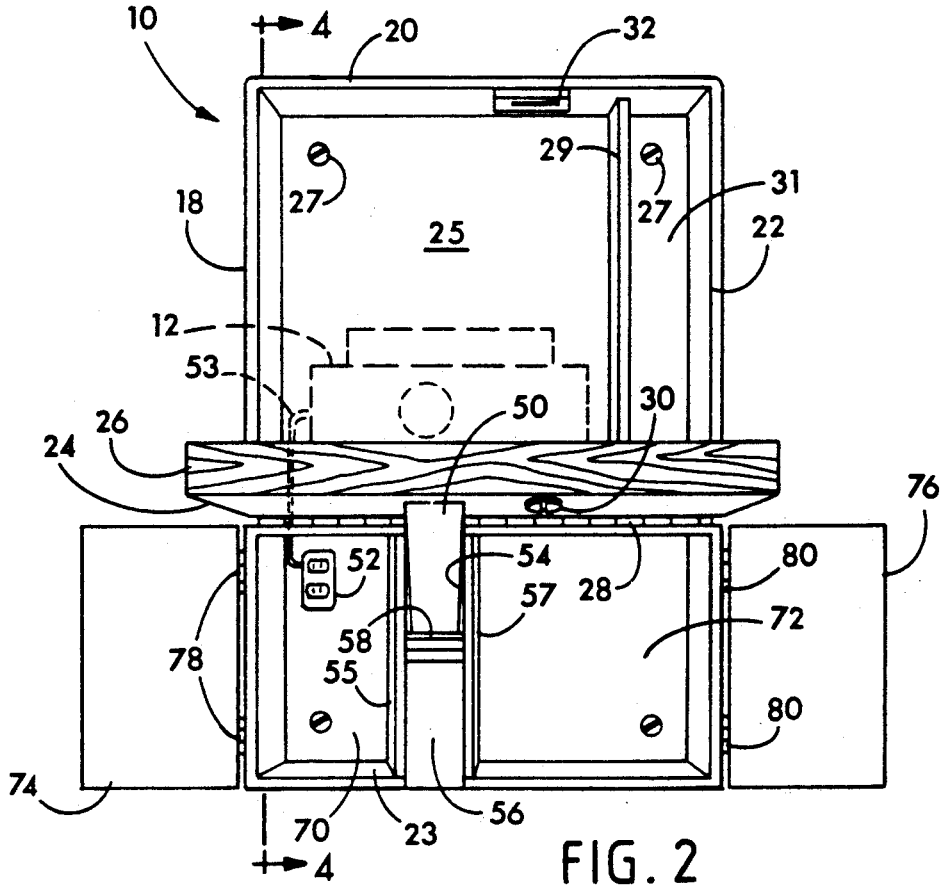
FIG. 2 is a front elevational view with the projector supporting door in its horizontal deployed position with the doors of the storage compartments open.
Figure 4:
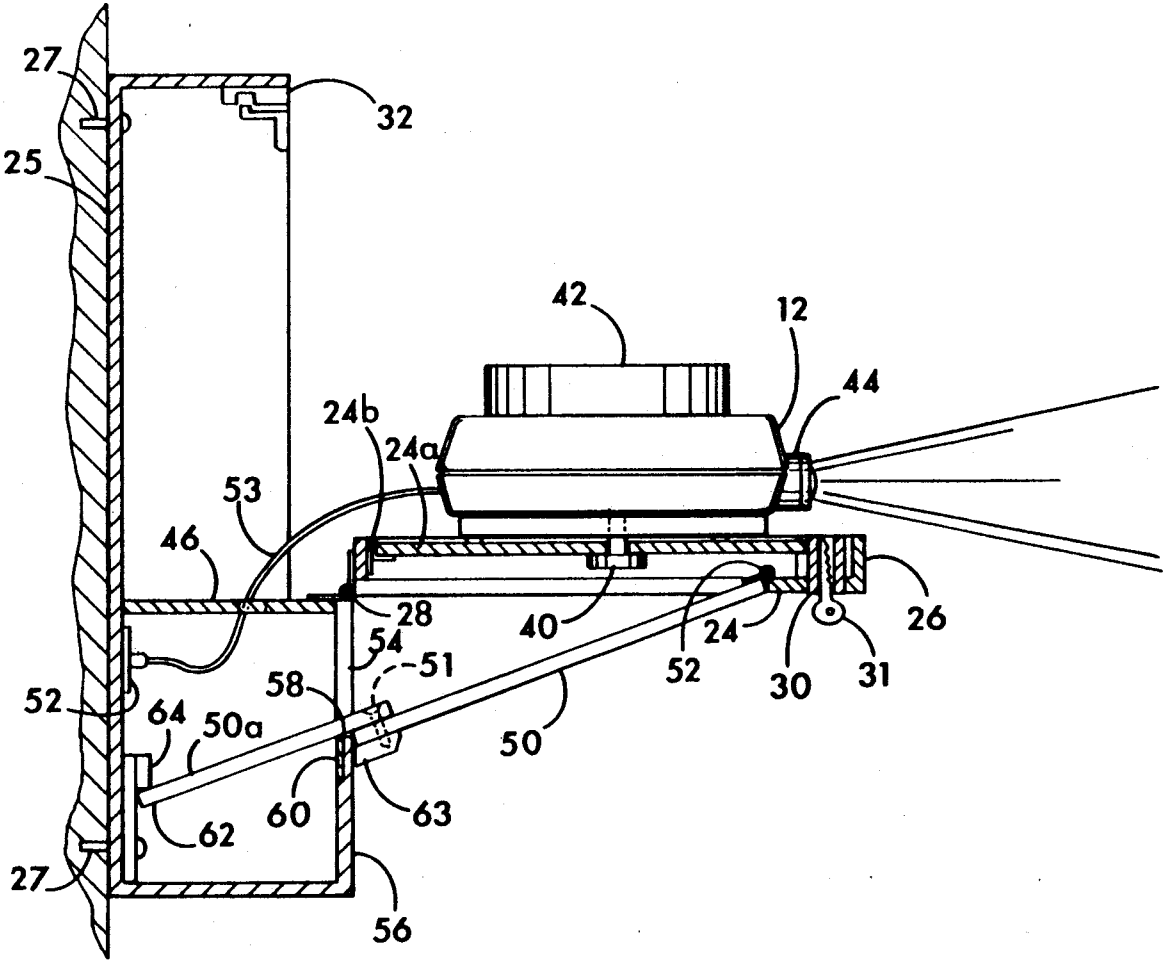
FIG. 4 is a vertical sectional view taken on line 4—4 of FIG. 2.
Figure 3:
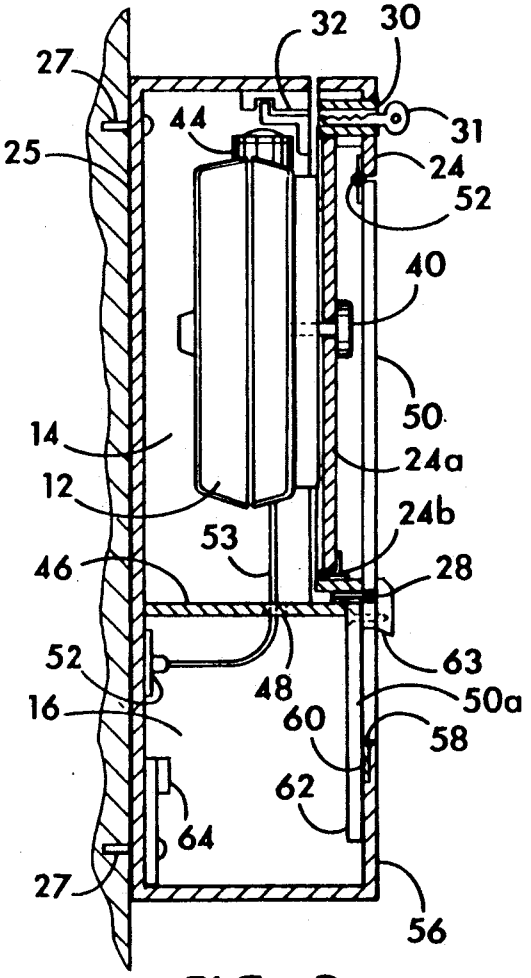
FIG. 3 is a vertical sectional view taken on line 3—3 of FIG. 1.

As shown, the cabinet 10 is oriented in an upright position against the wall of a room or recessed into the wall, if desired, and secured in place by means of any suitable fasteners, such as bolts 27 (FIGS. 2–4). Extending transversely between the upright wall 18, 22 is a horizontally disposed hinge 28. Enclosing the front of the upper aspect of the cabinet 10 is a door 24 which is connected at its lower edge to the hinge 28 so that it will swing during use from an upright position to a horizontal deployed position as shown in FIGS. 2 and 4. In this case, the door 24 has low walls 26 on three sides which are aligned with walls 18, 20 and 22 of the cabinet 10 when the door 24 is in the closed position.

The door 24 can be locked in the closed position by means of a key lock 30 which is opened by means of a key 31 for securing the lock 30 to a slot 32.

Inside the door 24 is a panel **24*a* to which the projector 12 is secured by means of a threaded fastener knob 40. The panel 24*a* is hinged to the door 24 by means of a transversely extending hinge 24*b* along its lower edge adjacent to the hinge 28. Hinge 24*b* allows the panel 24*a* to swing in one direction only; upwardly as shown in FIG. 4. This construction enables the panel 24*a* to be elevated by pivoting it about hinge 24*b* for the purpose of raising the projector 12 to allow the fastener 40** to be loosened or tightened as desired.

When the door 24 is in its horizontal position, it is securely supported in place by means of a brace arm 50 which is hinged at 52 to the door 24. The brace arm 50 extends through a slot between a pair of upright laterally spaced apart struts 54 and 55 that extend between the hinge 28 on the lower wall 23. Between the lower portion of the struts 54, 55 is a fulcrum supporting panel 56 having a fulcrum or lip 58 that extends laterally between the struts 54, 55. The brace arm 50 passes through the slot between the struts 54, 55 into the cabinet 10. The brace arm 50 can be one piece, but in the form shown, the brace arm has a lower portion 50*a* which is in lapped relationship with the upper portion and is held in place by means of a screw 51 so that the lower portion 50*a* rests on the lip 58 which serves as a fulcrum for the brace arm 50. A plastic, e.g. Teflon®, plate 60 can be provided on the inside surface of a panel 56 that extends between the struts 54, 55 to support the brace arm 50 and reduce friction as the lower portion 50*a* of the brace arm slides up and down on the fulcrum or lip 58. The brace arm portion 50*a* has a lower end 62 that, when the door 24 is in the horizontal deployed position, engages a retaining catch or plate 64 mounted on the back wall 25 of the cabinet 10. Also secured to the front of the brace arm 50 by means of a screw 51 is a stop 63. Thus, during operation when the door 24 is deployed to the horizontal position, the brace arm 50 and its lower extension 50*a* will slide from an upright position as shown in FIG. 3 to a diagonal position as shown in FIG. 4, with the stop 63 abutting against the panel 56 and the lower end portion 62 of extension 50*a* engaged in the lower edge of the retaining plate 64 which securely supports the projector supporting door or shelf 24 in a horizontal position so that the slides or other photographic material, for example in a carousel 42, can be projected as shown in FIG. 4 through a projection lens 44 onto a screen (not shown).

Extending between the top wall 20 and an intermediate wall 46 is a vertically disposed wall 29 to provide a compartment 31 for storing auxiliary equipment such as lenses or cords, etc. Beneath the transversely extending wall 46 is a chamber, in this case comprising a pair of compartments 70, 72 on opposite sides of the brace arm 50. The compartments 70, 72 can be closed by means of doors 74, 76, respectively, which are supported in turn by means of hinges 78, 80. The compartment 70 can be used, for example, for storing slides and the compartment 72 can be used for other auxiliary equipment including spare slide trays, video tapes or other equipment.

The intermediate wall 46 is provided with a passageway 48 for an electrical conductor 53 that passes through the opening 48 down to a wall plug 52 that is visible through an opening in the back wall 25 of the cabinet 10. Alternatively, if desired, the projector 12 can be hardwired into the electrical supply (not shown).

The cabinet 10 can be made of a variety of materials, including metal, plastic or wood as desired. If made of plastic, the hinge 28 can be a molded-in-place hinge, or what is known as a so-called "living" hinge. When the cabinet 10 is closed, the weight distribution of the projector 12 is directed towards the rear of the cabinet 10 so that the door 24 cannot fall open when the latch is not secured.

There are several kinds of remote operating methods that can be used within the scope of the invention. The projector 12 can be hard-wired into the electrical supply, strung through the wall or ceiling. If desired, an infrared remote operating control of known construction can be used. In this system, the operator points a control box (not shown) that provides an invisible beam toward a receiver located next to or on the projector to perform operating functions. In the alternative, a radio transmitter can be employed to operate the projector 12 in a known manner.

The invention is highly compact, rugged in construction and reliable in operation. It can be mounted on the surface of a wall or recessed into a wall and will always allow the projector 12 to be deployed for use in a stable horizontal position. The area on either side of the projector 12 is open so that the projector can be easily reached, and the projector will always be at its optimal focal position relative to the projection screen. The mechanism of the brace arm 50 is very simple in construction, but it provides a particularly firm support for the door 24 and does not interfere with the use of the compartments 70, 72. The invention allows the projector 12 to be locked in the cabinet 10, and since it does not move around a room like an ordinary projection cart, it does not have to be positioned relative to the projection screen; i.e., positioning is automatic.

Many variations of the present invention within the scope of the appended claims will be apparent to those skilled in the art once the principles described herein are understood.

What is claimed is

1. A wall mountable projector cabinet comprising, a cabinet body including a back wall, upright side walls, a top and a bottom wall connected together to provide an enclosure for a projector, an upright front door which serves as a projector supporting shelf for the projector, a transversely positioned hinge connected to the bottom of the door and extending horizontally on the front of the cabinet, said hinge being located in spaced relationship above the bottom wall of the cabinet for allowing the projector supporting door to swing downwardly from the top about the horizontal hinge, at least one storage compartment between the hinge and the bottom wall, means for defining an upright slot in the cabinet below the hinge and above the bottom wall of the cabinet, a supporting brace arm pivotally connected at an upper end thereof to the door and extending through the slot into the cabinet, and the cabinet including a retaining member for engaging the brace arm to support the brace arm in a position supporting the door when the door is opened and in a generally horizontal position serving as a shelf for the projector resting thereupon in position for projecting visual images.

2. The cabinet of claim 1 wherein the door includes a fastener for attaching the projector to an inner surface thereof.

3. The cabinet of claim 1 wherein the storage compartment has a door connected to the cabinet for closing the compartment and said door is positioned below the transverse hinge.

4. The cabinet of claim 3 wherein a pair of storage compartments are provided, each positioned laterally of the slot for the brace arm and a door is hingedly connected to the cabinet on either side thereof for closing each of the compartments.

5. The cabinet of claim 1 wherein a pair of vertically disposed laterally spaced apart struts extend from said transversely extending hinge to the bottom wall of the cabinet, said slot is defined between said upright struts and a transversely extending fulcrum member extends between the struts for supporting a portion of the brace arm between the ends thereof.

6. The cabinet of claim 1 wherein the brace arm has a stop thereon for engaging the cabinet.

7. The cabinet of claim 3 wherein the door has a hinged panel connected thereto for holding the projector.

8. The cabinet of claim 7 wherein a fastener connects the projector to the hinged panel.

9. A wall mountable projector cabinet comprising, a cabinet body including a back wall, upright side walls, a top and a bottom wall connected together to provide an enclosure for a projector, an upright front projector supporting door which serves as a shelf for supporting the projector, a transversely positioned hinge connected to the bottom of the door and extending horizontally on the front of the cabinet, said hinge being located in spaced relationship above the bottom wall of the cabinet, said hinge allowing the projector supporting door to swing downwardly from the top wall of the cabinet about the horizontal hinge, at least one storage compartment between the hinge and the bottom wall, a supporting brace arm pivotally connected at an upper end thereof to the door and extending diagonally downward to the cabinet when the door is in a generally horizontal open position, through the slot into the cabinet, and the cabinet including a retaining member for engaging the brace arm to support the brace arm in a position supporting the door when the door is in a generally horizontal open position whereby the door serves as a shelf for the projector resting thereupon in position for projecting visual images.

10. The cabinet of claim 9 wherein the door has a hinged panel for supporting the projector.

11. The cabinet of claim 10 wherein the arm has a lower end that extends into the cabinet and is supported by engagement with the cabinet.

12. A wall mountable projector cabinet comprising, a cabinet body including upright side walls, a top and a bottom wall connected together to provide an enclosure for a projector and said cabinet having a back portion to be mounted upon a wall of a room, a projector supporting door which serves as a shelf for supporting a projector, a transversely positioned hinge connected to a bottom portion of the door and extending horizontally on a front surface of the cabinet, said hinge being located in spaced relationship above the bottom wall of the cabinet, said hinge allowing the projector supporting door to swing downwardly from the top wall of the cabinet about the hinge, at least one storage compartment between the hinge and the bottom wall, at least one supporting brace arm, each such bracket arm having an upper end and a lower end, the upper end of the brace arm being connected to the door and the lower end extending into and being positioned within the cabinet, each such supporting bracket arm extending downwardly form the door when the door is raised to a closed position, a retaining member located at said back portion of the cabinet as a part of the cabinet for engaging the lower end of the brace arm to hold the brace arm in a position supporting the door when the door is in a generally horizontal open position with said brace arm member extending through cabinet from the a front wall to said back portion of the cabinet when the door is open whereby the door serves as the shelf for the projector resting thereupon to project visual image.

13. The cabinet of claim 12 wherein the door includes a fastener for attaching the projector thereto.

14. The cabinet of claim 12 wherein said storage compartment has a door connected thereof for closing said compartment and said storage compartment is located below said transverse hinge.

15. A wall mountable projector cabinet comprising, a cabinet body including upright side walls, a top and a bottom wall connected together to provide an enclosure for a projector and said cabinet having a back portion to be mounted upon a wall of a room, a projector supporting door which serves as a shelf for supporting a projector, a transversely positioned hinge connected to a bottom portion of the door and extending horizontally on a front surface of the cabinet, said hinge being located in spaced relationship above the bottom wall of the cabinet, said hinge allowing the projector supporting door to swing downwardly from the top of the cabinet wall about the hinge, at least one storage compartment between the hinge and the bottom wall of the cabinet, at least one supporting brace arm, said arm having an upper end and a lower end, the upper end of the brace arm being connected to the door and the lower end extends into the cabinet, each such supporting brace arm extends downwardly from the door when the door is raised to a closed position, a retaining member is connected to the cabinet, the lower end of the brace arm is positioned to strike the rearing member to retain the brace arm in a position supporting the door when the door is in a generally horizontal open position, a panel is connected to the door by means of a hinge and is positioned inside the door for supporting the projector by being connected to the projector, whereby panel and door serve as the a shelf for the projector to rest thereon while projecting visual images.

16. The cabinet of claim 15 wherein said storage compartment has a door connected thereto for closing said storage compartment and said storage compartment door is located below said transverse hinge.

17. The cabinet of claim 15 wherein said cabinet has a rear wall and the cabinet has means for receiving fasteners for connecting the rear wall of the cabinet to the wall of a room.

18. The cabinet of claim 15 wherein the door has a top end and a retaining means is connected to the top end of the door for keeping the door in a close upright position.

19. The cabinet of claim 18 wherein the retaining means is a key lock.

* * * * *

UNITED STATES PATENT AND TRADEMARK OFFICE

CERTIFICATE OF CORRECTION

PATENT NO. : 5,211,456
DATED : May 18, 1993
INVENTOR(S) : Staffaroni

It is certified that error appears in the above-indentified patent and that said Letters Patent is hereby corrected as shown below:

Column 5, line 62, change "bracket" to ---brace---.

Column 6, line 1, change "bracket" to ---brace---. Line 16, change "thereof" to ---thereto---. Line 43, change "rearing" to ---retaining---.

Signed and Sealed this

Fifth Day of April, 1994

Bruce Lehman

*Attest:*

BRUCE LEHMAN

*Attesting Officer*

*Commissioner of Patents and Trademarks*